US005195347A

United States Patent [19]

Seto et al.

[11] Patent Number: 5,195,347

[45] Date of Patent: Mar. 23, 1993

[54] GUIDE DEVICE FOR SHAPE ROLLING

[75] Inventors: Tsuneo Seto; Atsushi Hatanaka; Hironori Miura; Youji Fujimoto, all of Okayama, Japan

[73] Assignee: Kawasaki Steel Corporation, Japan

[21] Appl. No.: 811,173

[22] Filed: Dec. 19, 1991

[30] Foreign Application Priority Data

| | | | |
|---|---|---|---|
| Dec. 27, 1990 | [JP] | Japan | 2-408520 |
| Jul. 19, 1991 | [JP] | Japan | 3-203691 |
| Oct. 30, 1991 | [JP] | Japan | 3-311940 |

[51] Int. Cl.[5] ..... B21B 39/20

[52] U.S. Cl. ..... 72/251; 72/250

[58] Field of Search ..... 72/251, 250, 247, 224, 72/225

[56] References Cited

U.S. PATENT DOCUMENTS

| | | | |
|---|---|---|---|
| 3,566,656 | 3/1971 | Matsumuro | 72/250 |
| 5,031,435 | 7/1991 | Seto et al. | 762/247 |

FOREIGN PATENT DOCUMENTS

| | | | |
|---|---|---|---|
| 0054517 | 3/1987 | Japan | 72/250 |
| 0018518 | 1/1989 | Japan | 72/250 |
| 0034510 | 2/1989 | Japan | 72/250 |
| 0080113 | 3/1990 | Japan | 72/251 |
| 0284713 | 11/1990 | Japan | 72/250 |
| 0284714 | 11/1990 | Japan | 72/250 |

*Primary Examiner*—Lowell A. Larson
*Assistant Examiner*—Michael J. McKeon
*Attorney, Agent, or Firm*—Austin R. Miller

[57] ABSTRACT

A guide device for shape rolling has upper and lower pairs of width-variable web guides arranged at the delivery of a shape mill. Support bases supporting the upper and lower pairs of web guides. Movable bases move the support bases horizontally on side frames whose ends are fixed to guide frames. Guide width adjusting devices individually adjust the distance between the movable bases; and guide height adjusting devices enable the side frames to ascend and descend. Preferably, upper and lower pairs of flange end guide rollers and flange-outer-surface guide rollers, which are adapted to roll while in contact with the end surfaces and the outer surfaces of the flanges, can move in the vertical and horizontal directions.

3 Claims, 5 Drawing Sheets

GUIDE DEVICE FOR SHAPE ROLLING

BACKGROUND OF THE INVENTION

1. Field of the Invention

This invention relates to a guide device for the delivery portion of a shape mill for rolling shapes such as H-beams, I-beams or channels, for example. The invention further relates to a device for simplifying guide rearrangement, which is required for each shape size when rolling shapes of different sizes, thus improving rolling efficiency.

2. Description of the Related Art

When rolling steels with a shape mill, a guide device is usually employed in order to guide the material to be rolled correctly to the rolls and to restrain web off-centering, differences in upper and lower flange depth, etc.

Such a guide device is arranged at the entry and/or delivery side of the shape mill and usually consists of a flange guide device for the vertical rolls and a web guide device for the horizontal rolls.

Japanese Patent Laid-Open No. 2-211908 discloses a flange guide device for vertical rolls, according to which the flange outer surfaces are guided by means of chock cover plates, and a web guide device for horizontal rolls, which, as shown in FIG. 6, consists of upper and lower web guides 2 which are adapted to guide the web portion 1*a* of an H-beam 1 while holding it between them.

Such a conventional web guide as described above, however, is intended for use at a fixed web width. Accordingly, it requires replacement each time the size of the H-beams is changed, which requires much labor. Further, it is necessary to stock a variety of different guide devices for different sizes, which is further disadvantageous from the economical point of view.

In view of this, the present applicant has proposed, in Japanese Utility Model Laid-Open No. 61-67907, a variable-width web guide device, which adopts web guides separated in the width direction to allow lateral positional adjustment in accordance with the roll width; this is done by means of right- and left-hand screws reversely threaded. With this variable-width web guide device, however, the amount of width adjustment is physically limited in terms of space, so that the guides have to be replaced for each different series of products. Further, it takes time to perform guide alignment with respect to the rolling rolls.

Japanese Patent Laid-Open No. 63-68204 discloses a guide device in which the distances between the web guides for guiding the web surfaces and the distance between the guide rollers for guiding the outer flange end surfaces are fixed. This technique is intended for a shape product exhibiting a minimum dimension between the web surfaces and the outer flange end surfaces, so that when the guide members have been worn to a considerable degree, or when the size of the object to be rolled is frequently changed, the distance between the web guides and the web of the shape becomes excessively large, making the guiding of the web surface unstable, which results in deterioration in shape.

Japanese Patent Laid-Open No. 64-2715 discloses a shaft supporting a taper roller guide formed as an eccentric shaft, which is rotated so as to adjust the distance between the web guide surface and the taper roller guide. In accordance with this technique, the web guides can be appropriately positioned in accordance with the degree of wear of the guide members and changes in the distance between the web surfaces of the shape and the outer flange end surfaces (hereinafter referred to as the "flange depth"). Because of its eccentricity, however, such an eccentric shaft presents a problem in terms of the way it is fixed. Further, there is a variation in the balance of force when adjusting the distance. In addition, because of the bending moment acting in response to the pressure load, the strength of the section where the shaft rotation is stopped becomes particularly inadequate. Moreover, since the eccentric shaft is of a stationary type, it has been impossible to adjust it in accordance with the flange depth, which varies for each pass in the on-line operation.

SUMMARY OF THE INVENTION

It is an object of this invention to provide a shape guide device which is capable of realizing size-free rolling.

In accordance with this invention, there is provided a guide device for shape rolling of the type which includes upper and lower pairs of width-variable web guides arranged on the entry and/or delivery side of a shape mill, with: support bases supporting the web guide pairs; movable bases which laterally move the support bases on side frames whose ends are fixed to guide frames; guide width adjusting devices which individually adjust the distance between the movable bases; and guide height adjusting devices which enable the guide frames and side frames fixed thereto to ascend and descend; and, further, upper and lower pairs of flange end guide rollers adapted to roll while in contact with the web guides and the flange end surfaces of the shape; moving means for moving the upper and lower web guides and the flange end guide rollers simultaneously in the vertical or horizontal direction; and ascent/descent means which allows only the flange end guide rollers to move independently in the vertical direction.

In accordance with this invention, the width of the separate web guide pairs can be individually adjusted and, at the same time, the flange end guide rollers and flange-outer-surface guide rollers, which are adapted to roll while respectively in contact with the end surfaces and outer surfaces of the flanges, can move in the vertical and horizontal directions, so that rolling can be performed without replacing the guides even when the shape size or the pass line is changed.

Other structural features of this invention will become apparent from the following detailed description along with variations thereof.

DESCRIPTION OF THE PREFERRED EMBODIMENTS

Figure 1:
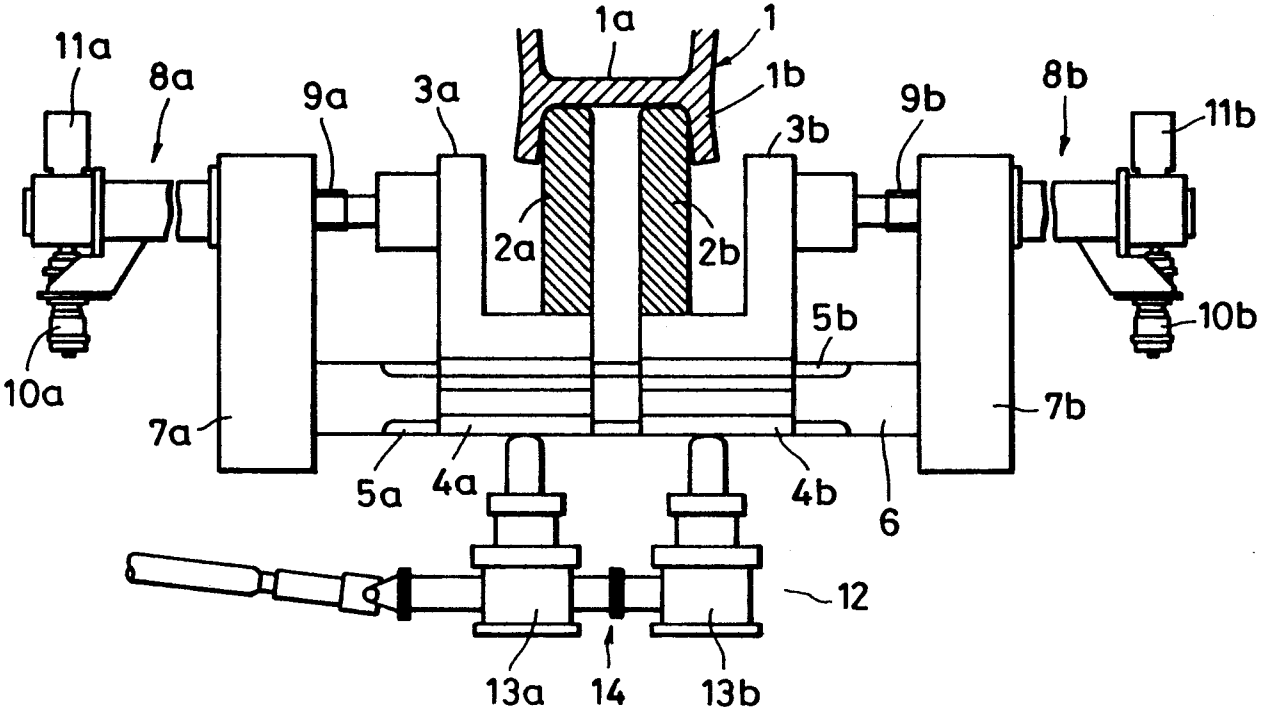
FIG. 1 is a schematic front view, partly in section, of an embodiment of this invention.

An embodiment of this invention will now be described in detail with reference to FIG. 1, which shows an H-beam rolling guide device as arranged at the entry of a shape mill. The guide device of FIG. 1 has a completely symmetrical structure, both vertically and horizontally, with respect to the rolling pass line, so the drawing shows only the lower section thereof.

Lower web guides 2*a* and 2*b* are respectively secured to L-shaped support bases 3*a* and 3*b*, which are fastened to movable bases 4*a* and 4*b* adapted to be guided along grooves 5*a*, 5*b* provided on a side frame 6 whose ends are respectively fixed to guide frames 7*a* and 7*b*.

Reference numerals 8*a* and 8*b* indicate guide-width adjusting devices for changing guide width which are adapted to move the web guides 2*a* and 2*b* along the grooves 5*a*, 5*b* of the side frame 6. The guide width adjusting devices 8*a* and 8*b* have screw rods 9*a* and 9*b* for guide width changing which are rotatably held by the guide frames 7*a* and 7*b*; members such as nuts (not shown) each having one end connected to the screw rods 9*a*, 9*b* and the other end connected to the support bases 3*a*, 3*b* holding the web guides 2*a*, 2*b* and incorporating into the guide frame 7*a*, 7*b*; motors 10*a* and 10*b* for rotating the screw rods 9*a* and 9*b*; and position detectors 11*a* and 11*b*.

A guide height adjusting device 12 consists of jacks 13*a* and 13*b* for moving the side frame 6 together with the web guides 2*a* and 2*b* up and down, and are driven by a drive shaft 14.

To minimize a difference of level between the right and left sections of the apparatus the jacks 13*a* and 13*b* are connected together by the drive shaft 14 and are driven by the same driving means (not shown).

Due to the construction of the lower section of the guide device, the distance in the width direction between the guides can be adjusted by operating the guide width adjusting devices 8*a* and 8*b*, and, by operating the guide height adjusting device 12, the position of the guides in the height direction can be adjusted.

Regarding the upper section of this guide device, it is essentially the same as the lower section and is arranged symmetrically above the pass line of the beam and accordingly allows adjustment of width and height directions in the same manner as described above.

Figure 2:
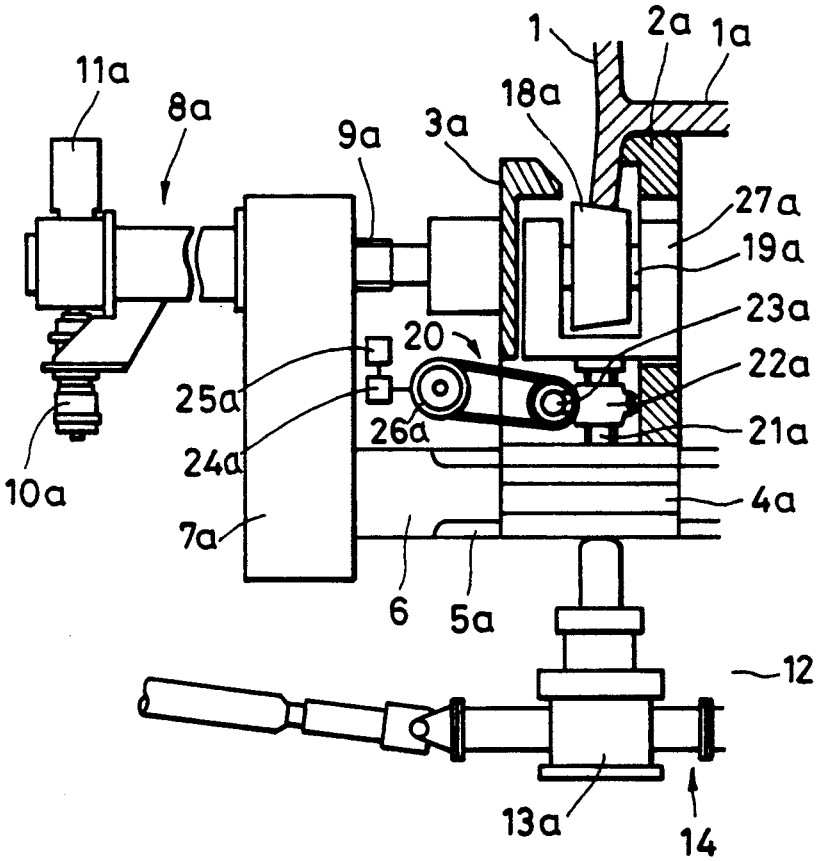
FIG. 2 is a one-side schematic front view, partly in section, of another embodiment of this invention.
Figure 3:
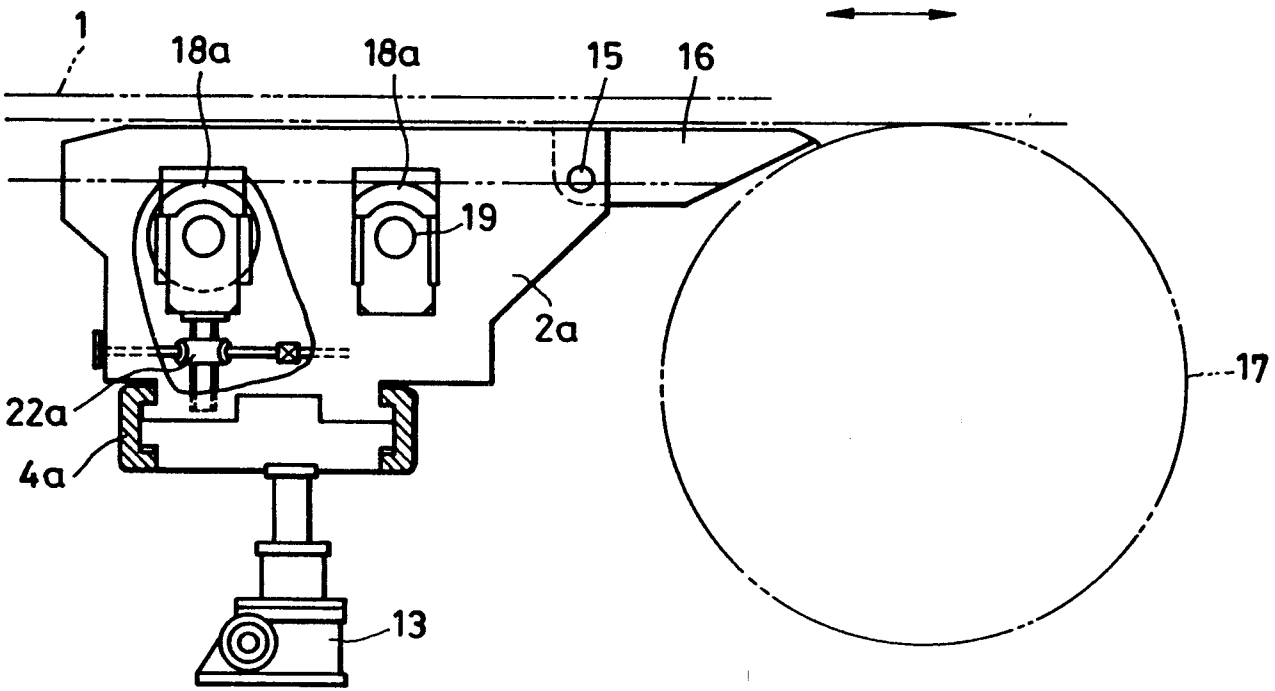
FIG. 3 is a side view of an important part of FIG. 2.

Next, another embodiment of this invention will be described with reference to FIGS. 2 and 3. The embodiment exhibits a completely symmetrical structure, both vertically and horizontally, with respect to the rolling pass line of the beam, so the drawings show only the lower left section thereof.

Reference numeral 18*a* indicates flange end guide rollers which are adapted to roll while in contact with the end surfaces of the flanges 1*b* of the H-beam 1. The flange end guide rollers 18*a* are rotatably mounted on the bearing stands 27*a* through axles 19.

As stated above, the bearing stand 27*a* is vertically movably mounted on the movable base 4*a*, which is adapted to be guided along the groove 5*a* provided on the side frame 6, whose ends are fixed to the guide frames 7*a* and 7*b*.

The position in the width direction of the movable base 4*a* is adjusted by the guide width adjusting device 8*a* mentioned above.

In order that the amount of movement of the flange end rollers 18*a* and web guide 2*a* may be correctly ascertained, these rollers are constantly monitored by the position detector 11*a*.

The adjustment in the height direction of the web guide 2*a* and the flange end guide rollers 18*a* is effected by means of the guide height adjusting device 12.

Reference numeral 20 indicates an ascent/descent means for moving the flange end guide rollers 18*a* independently of the web guide 2*a*. The ascent/descent means 20 has a vertically movable screw rod 21*a* one end of which is connected to the flange end guide rollers 18*a* and the bearing stand 27*a*, and is driven by a worm wheel 22*a* fitted onto the screw rod 21*a*. A worm 23*a* is engaged with the worm wheel 22*a* and a gear 26*a* is connected to the worm 23*a* through a chain or the like. A drive source 24*a* and a synchro 25*a* are connected to the gear 26*a*. It is accordingly possible for the right and left ascent/descent means 20 to effect vertical movement individually. Since, however, the upper and lower flange end guide rollers are arranged in pairs, it is usually more expedient to connect the pairs through a connecting shaft so that they can move simultaneously, and to arrange a clutch or a gear coupling in the middle of the connecting shaft so as to compensate for any fluctuation in level due to a difference in the wear of the rollers.

In accordance with this embodiment, the flange end guide rollers 18*a* can be moved up and down independently of the web guides 2*a* so that the distance between the roller surfaces of the flange end guide rollers 18*a* and the guide surface of the web guide 2*a* can be individually adjusted, whereby the flange end surfaces are roller-constrained so as to keep the distance between the web and web guides constantly at an appropriate value even when there is a change in H-beam dimension, such as flange depth, or when a dimensional fluctuation occurs as a result of the flange end guide rollers and the web guides being worn.

Further, it is possible to keep the horizontal distance between the web and web guides constant irrespective of the flange depth, so that a scraper 16 (FIG. 3), which is provided, in particular, at the front end of the web guide 2*a* through a pivot pin 15, can be kept substantially horizontal, though there may be some variation in the degree of horizontality depending on the diameter of the horizontal rolls 17 of the universal mill. Thus, a high level of guiding precision is obtained in close vicinity of the horizontal rolls of the universal mill, thereby effectively reducing defects such as warping and advantageously restraining web off-centering at the front and rear ends of the H-beam.

Figure 4:
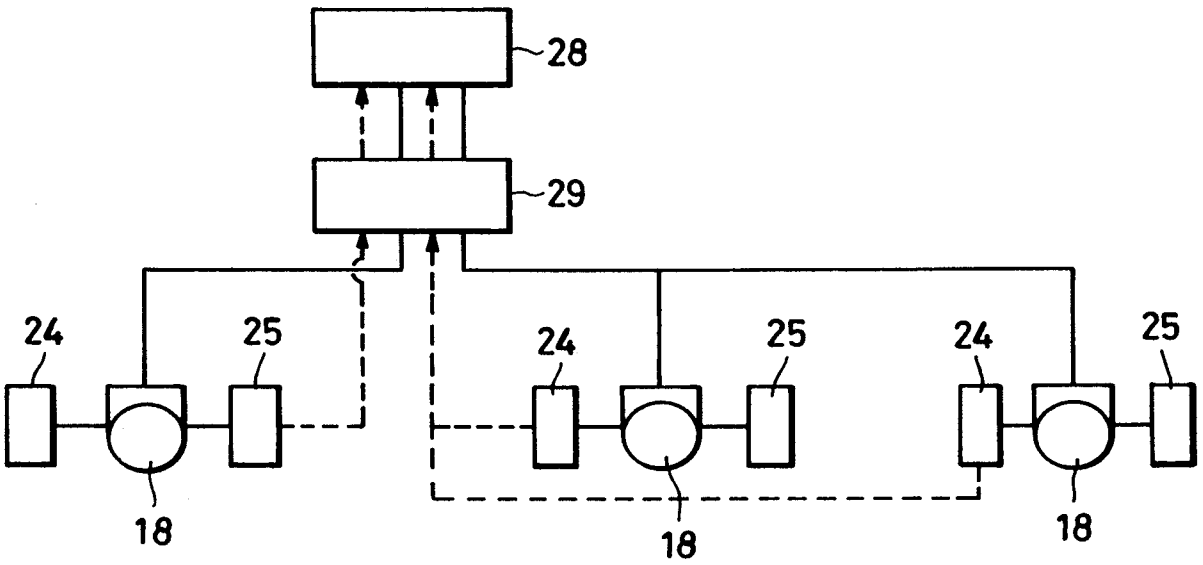
FIG. 4 is a block diagram showing a control system which can be suitably applied to the guide device of the embodiment shown in FIG. 2.

Further, it is possible to realize automatic control by constructing a control system in which a memory unit 28 and a controller 29 are provided, as shown in FIG. 4.

Next, still another embodiment of this invention will be described with reference to FIG. 5. As in the previous embodiment, only the lower left section of the device is shown since the embodiment exhibits a structure which is essentially symmetrical, both vertically and horizontally, with respect to the rolling pass line.

Figure 5:
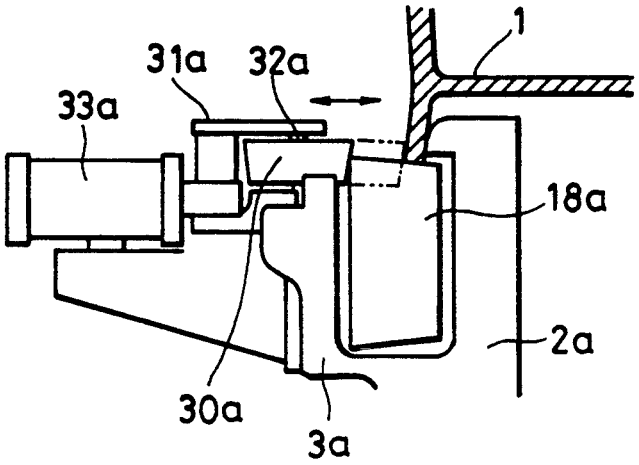
FIG. 5 is a one-side schematic front view, partly in section, of still another embodiment of this invention.
Figure 6:
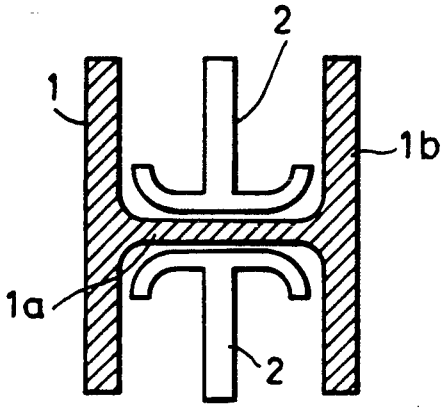
FIG. 6 PRIOR ART
FIG. 6 is a diagram illustrating a prior-art example.

The embodiment of FIG. 5 includes flange end guide rollers 18*a*, web guides 2*a* and flange-outer-surface guide rollers 30*a* having a function of guiding the flange outer surfaces.

The flange-outer-surface guide rollers 30*a* are rotatably mounted on a frame 31*a* attached to the support base 3*a*, through axles 32*a*. Their positioning with respect to the outer flange surfaces is effected by means of cylinders 33*a*.

By virtue of the above construction, it is possible to control the positions of the flange-outer-surface guide rollers in accordance with the flange thickness and web height, thereby preventing reduction of flange thickness or web height, flaw generation on the inner flange surfaces, and external flange slanting as a result of the flange-outer-surface guide rollers being forced in, as well as configuration defects such as off-centering.

While the present invention has been described with reference to the rolling of an H-beam, the invention is also applicable to other types of shapes, such as I-beams or channels, for example.

Thus, in accordance with this invention, the guides for guiding the material to be rolled can be appropriately positioned on-line for each pass even in a case where shapes of different flange depths are to be rolled in the same rolling line, thus making it possible to obtain shapes having a high level of dimensional precision.

What is claimed is:

1. A guide device for shaped steel rolling of the type which includes a shape rolling mill for rolling shaped steel, said shaped steel passing through said mill in a rolling direction generally along a plane of a pass line of said mill, further including upper and lower pairs of width-variable web guides arranged on an entry and/or a delivery side of said shape mill, said guide device comprising:

upper and lower pairs of support bases supporting said upper and lower pairs of web guides;

said support bases being mounted on upper and lower pairs of movable bases, said movable bases being movable in a direction generally transverse to the rolling direction and generally in the plane of rolling;

upper and lower side frames, each of said side frames having ends thereto, enabling movement of said movable bases, while supporting said movable bases;

upper and lower pairs of guide frames, each of said guide frames being an individual end of a respective one of said side frames while fixing said individual end of said side frame;

guide width adjusting means connecting to individually adjust distance between said movable bases of the respective pairs; and guide height adjusting means connected for adjusting the heights of said web guide pairs, as supported by said side frames and said guide frames, in a direction generally transverse to the plane of rolling.

2. A guide device for shaped steel rolling as claimed in claim 1, further comprising:

upper and lower pairs of flange end guide rollers carried by said upper and lower pairs of support bases, respectively, each adapted to roll while in contact with an end surface of a flange of a shape being rolled; and ascent/descent means for moving said flange end guide rollers in a direction generally transverse to the plane of rolling.

3. A guide device as claimed in claim 1 further comprising:

upper and lower pairs of flange-outer-surface guide rollers carried by said upper and lower pairs of support bases, respectively, and adapted to roll while in contact with an outer surface of a flange of a shape being rolled; and lateral moving means for moving said flange-outer-surface guide rollers in a direction generally transverse to the rolling direction and generally in the plane of rolling.

* * * * *